United States Patent [19]

Akiyama

[11] Patent Number: 4,792,131

[45] Date of Patent: Dec. 20, 1988

[54] OFF-LINE IMAGE FIXING APPARATUS

[75] Inventor: Noboru Akiyama, Iwatuki, Japan

[73] Assignee: Fuji Xerox Co., Ltd., Tokyo, Japan

[21] Appl. No.: 108,817

[22] Filed: Oct. 14, 1987

[30] Foreign Application Priority Data

Oct. 24, 1986 [JP] Japan ..... 61-253493

[51] Int. Cl.[4] ..... B65H 7/08

[52] U.S. Cl. ..... 271/7; 271/265; 271/902; 400/708

[58] Field of Search ..... 271/261, 263, 265, 259, 271/258, 7, 227, 902; 355/3 FU; 219/216; 400/708, 708.1, 636.1, 636, 632, 633, 603; 209/534; 198/464.4, 577, 464.2, 572, 810, 857

[56] References Cited

U.S. PATENT DOCUMENTS

| | | | |
|---|---|---|---|
| 4,243,869 | 1/1981 | Scribner | 219/216 |
| 4,391,509 | 7/1983 | Caragnaro | 355/3 FU X |
| 4,548,401 | 10/1985 | Nishikawa | 271/265 |

OTHER PUBLICATIONS

Lawrence P. Lavery; Document Handler Jam Detection, Xerox Disclosure Journal, vol. 6, No. 5, 9-10/1981, p. 263.

*Primary Examiner*—Joseph J. Rolla
*Assistant Examiner*—Stephen B. Parker
*Attorney, Agent, or Firm*—Spensley Horn Jubas & Lubitz

[57] ABSTRACT

An off-line image fixing apparatus includes a feed sensor disposed at the center of a paper inlet for sensing the presence of a sheet of copying paper, and a controller for forwardly driving a paper conveyor, which is in a normal state continuously driven backwardly in accordance with a paper sensing signal from the feed sensor. Thus a sheet of copying paper can be inserted from only the central portion of the paper inlet, so that a sheet of copying paper inserted from the paper inlet and conveyed to the heating unit passes necessarily over a paper jam sensor disposed in the center of the conveyance passageway.

11 Claims, 3 Drawing Sheets

OFF-LINE IMAGE FIXING APPARATUS

BACKGROUND OF THE INVENTION

This invention relates generally to an image fixing apparatus which fixes unfixed picture information image formed on a sheet of copying paper thereto, and more particularly to a so-called off-line image fixing apparatus which is disposed separately from a reproduction machine to perform only a fixing function.

FIG. 1 is a perspective view of a conventional off-line image fixing apparatus 1 with its parts being broken away to show the essential portion thereof.

The apparatus 1 includes a heating unit 3 disposed within the apparatus body 2 including a casing to heat and fuse an unfixed toner image (picture information which has been developed, but not fixed yet), a vacuum paper conveyor 4 which conveys a sheet of copying paper to the heating unit 3, and a discharger 5 which discharges the sheet, on which the picture information is fixed, from the back of the body.

The heating unit 3 includes a plate heater 6 disposed below a paper conveyance passageway shown by the arrow A and a- quartz type heater lamp disposed opposite to the heating unit 6. The sheet of copying paper on which the picture information has been fixed is discharged from the body 2 by the discharger 5 including a pair of rollers 7 and 8. The vacuum type paper conveyor 4 includes a vacuum producing casing 9 and a belt 10 wound around the casing 9 to draw a sheet of copying paper to the belt and convey it. The conveyor 4 is disposed so as to face the body front 2*a* which has a paper inlet 2*b* extending widthwise of the paper conveyance passageway A so as to permit insertion of a few of various sized sheets of copying paper 11, 12. The image fixing apparatus 1 uses the heating unit 3, so that when paper jamming occurs in the paper passageway A, the sheet may scorch. In order to cope with this, jam sensors 13 are disposed at the center of the width of the conveyor passageway A so that a jam detection signal from each sensor 13 may stop the operation of the image fixing apparatus 1 to thereby permit removal of the sheet of copying paper which has jammed. In FIG. 1, reference numeral 14 denotes a stock plate which accommodates thereon a sheet of copying paper 15 after fixing.

In this image fixing apparatus 1, jam sensors 13 are disposed only at the center of the width of the paper passageway A. When a wide sheet of copying paper 12 passes over jam sensors 13 and jams, this jamming will be detected, so that there are no problems Especially, when a narrow sheet of copying paper 11 is inserted from right-hand or left-hand end portion of the inlet 2*b*, as shown by a dot-dashed line, it does not pass over the jam sensors 13, so that when the sheet 11 jams, the jam sensor 13 cannot detect it and the sheet of copying paper within the body 2 may scorch. Such a problem could be solved by disposing many jam sensors 13 over the overall width of the sheet passage A. However, such provision of many jam sensors 13 would invite an increase in the number of components of the apparatus to thereby reduce the productivity and increase the cost. It is virtually impossible to dispose many jam sensors 13 over the paper conveyance passageway A having a narrow space.

It is an object of this invention to provide an image fixing apparatus which detects jamming of one of various sized sheets of copying paper to prevent scorching of the sheets.

It is another object of this invention to provide an inexpensive, high-productivity image fixing apparatus which is obtained by addition of a few parts to the conventional apparatus and which detects jamming of one of various sized sheets of copying paper to prevent scorching of the sheet.

Other objects and advantages of this invention will be easily ascertained by the following detailed description and accompanying drawings.

SUMMARY OF THE INVENTION

This invention provides an off-line image fixing apparatus which according to this invention comprises:

paper inlet means formed in the front of the apparatus body for allowing insertion of a sheet of copying paper therethrough;

heating means disposed backward within the body;

paper passageway means formed so as to extend from the inlet means to the heating means for allowing the sheet of copying paper to pass therethrough;

paper conveyor means disposed in the paper passageway means between the heating means and the paper inlet means for conveying the sheet of copying paper;

jam sensor means disposed at the center of the width of the paper passageway means for sensing possible jamming of a sheet of copying paper occurring in the paper passageway means;

feed sensor means disposed at a position in the sheet inlet means corresponding to the center of the width of the paper passageway means for sensing the presence of a sheet of copying paper; and control means for normally driving the conveyor means in such a direction that a sheet of copying paper is prevented from moving from the inlet means to the passageway means and for driving the conveyor means in accordance with a paper sensing signal from the feed sensor means so that the sheet is allowed to enter the passageway means from the paper inlet.

Thus, each of sheets of copying paper having various sizes is arranged to be inserted into the passageway means only from a position in the inlet means corresponding to the center of the width of the passageway means so that the sheet of copying paper conveyed by the conveyor means to the heating means may pass over the jam sensor means disposed at the center of the width of the passageway means.

DETAILED DESCRIPTION OF THE PREFERRED EMBODIMENT

Figure 1:
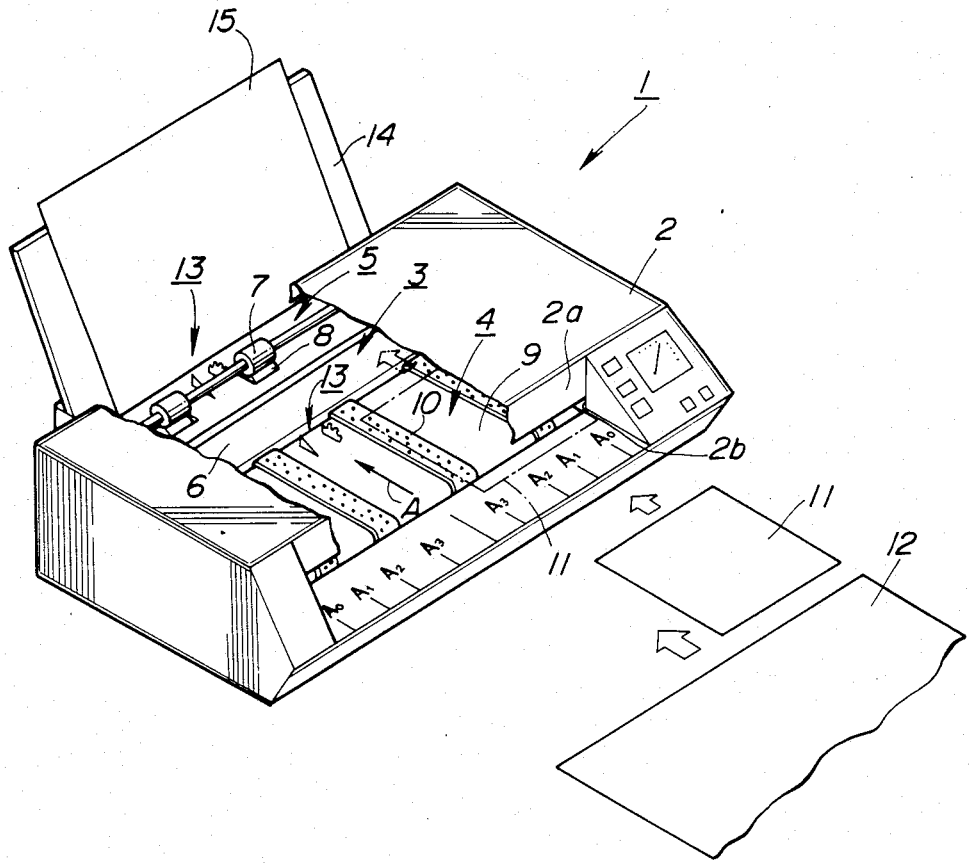
FIG. 1 PRIOR ART
FIG. 1 is a perspective view of a conventional off-line image fixing apparatus with its parts being broken away to show the essential portion of the apparatus.
Figure 2:
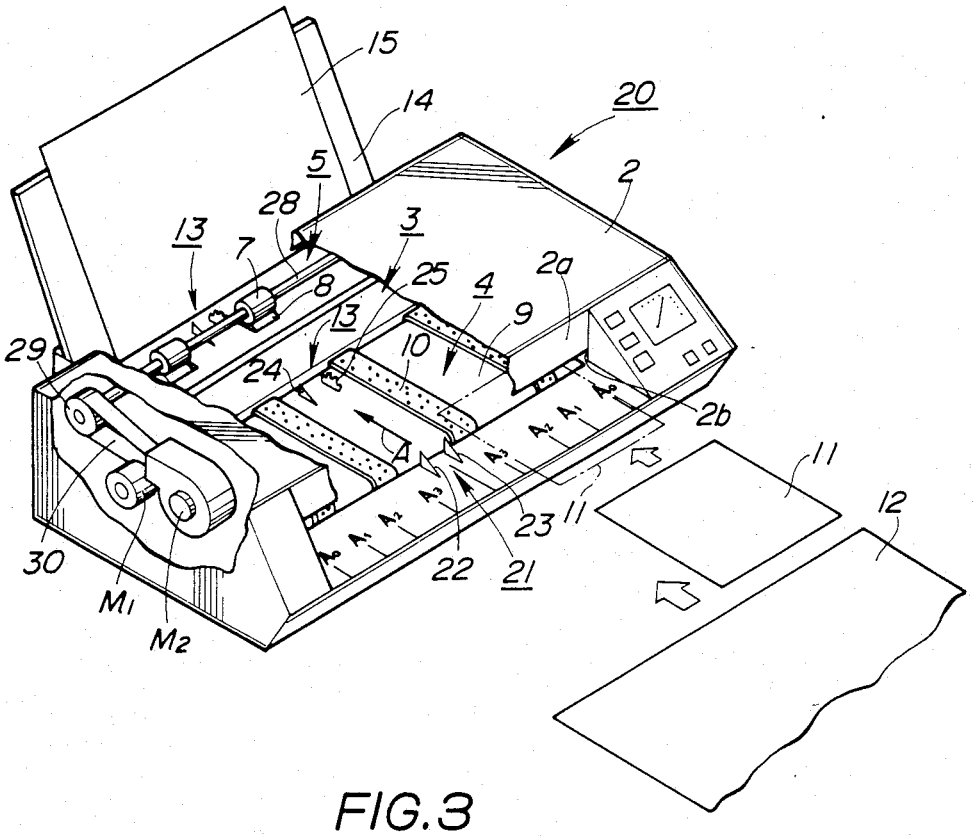
FIG. 2 is a perspective view of an off-line image fixing apparatus according to this invention with its parts being broken away to show the essential portion of the apparatus.

FIG. 2 is a perspective view of an off-line image fixing apparatus 20 according to this invention with its parts being broken away to show the essential portion thereof. Like reference numerals denote like parts in FIGS. 1 and 2.

The image fixing apparatus 20 has a paper inlet 2*b* formed in the front of the apparatus body 2. A feed sensor 21 is disposed centrally in the inlet 2*b* to detect the presence of a sheet of copying paper. It is to be noted that the center of the paper inlet 2*b* coincides with the center of the width of a paper conveyance passageway (the arrow A) formed within the apparatus body 2. The feed sensor 21 is constituted by a pair of well-known photointerrupter sensor elements 22 and 23 which are disposed in opposing relationship so as to have paper jam sensors 13 disposed therebetween at the center of the width of the paper passageway A, as viewed from the front of the apparatus body 2. The jam sensors 13 are disposed at two points, one on the paper conveyor 4 disposed in the conveyance passageway A between the sheet inlet 2*b* and the heating unit 3, and another being downstream of the passageway A positioned after the heating unit 3. Both the sensors are disposed along the center line of the conveyance passageway A. Each jam sensor 13 includes a well-known photointerrupter type sensor element 24 which detects the presence of a sheet of copying paper and a well-known photopulse generation type sensor element 25 which senses a change in the moving condition of the sheet of copying paper. In FIG. 2, reference sign M1 denotes a motor which drives the paper conveyor 4 and a paper discharger 5. Reference sign M2 denotes a blower motor which generates a vacuum within the casing 9 of the conveyor 4. The driving of these motors M1 and M2 is controlled by a control system to be described later. The motor M1 and a shaft 28 which support a roller 7 of the paper discharger 5 are connected by a one-way clutch 29 fixed to the shaft 28 and a belt 30 engaged around a clutch 29. The one-way clutch 29 is use to transmit to the roller 7 the forward rotation of the motor M1, namely, a drive force to feed a sheet of copying paper only downstream of the paper conveyance passageway A.

The control system which controls the driving of the motors M1 and M2 will now be described.

Figure 3:
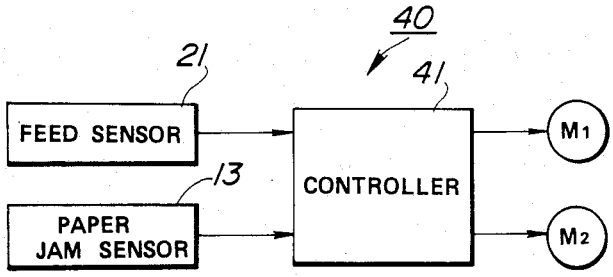
FIG. 3 is a block diagram of a control system used in the image fixing apparatus shown in FIG. 2.

FIG. 3 is a block diagram showing the control system 40 which includes a controller 41 which controls the driving of the motors M1 and M2 in accordance with the detection signals from the feed sensor 21 and the jam sensors 13. When the controller 41 does not receive a paper sensing signal from any one of the feed sensor 21 and jam sensor 13, it continuously delivers a drive signal to the motor M1 to drive same backwardly. When the controller 41 receives a paper sensing signal from one or both of the feed sensor 21 and the jam sensor 13, it delivers a drive signal to the motor M1 so as to rotate same forwardly to thereby convey a sheet of copying paper, inserted from the paper inlet 2*b*, downstream of the passageway A (toward the heating unit 3). When the controller 41 receives a paper sensing signal from one or both of the feed sensor 21 and the jam sensor 13, it delivers a drive signal to the motor M2 so as to rotate same to thereby generate a vacuum within the casing 9 shown in FIG. 2. It is to be noted that the paper detection signal from the feed sensor 21 is generated when the pair of the photointerrupter type sensor elements 22 and 23, constituting the feed sensor 21, are both actuated by a sheet of copying paper. Therefore, the sheet of copying paper which has actuated both of the sensor elements 22 and 23 necessarily passes over the paper jam sensor 13 positioned between the sensors 22 and 23 downstream of the paper passageway A.

The operation of the image fixing apparatus 20 as mentioned above will now be described and at the same time the structure of this invention will also be described in more detail.

As shown in FIG. 2, when a narrow sheet of copying paper 11 is inserted from the right-hand portion of the paper inlet 2*b*, the feed sensor 21 is not actuated, so that in this case the reverse driving of the motor M1 by the control system 40 shown in FIG. 3 is maintained. This causes the sheet of copying paper 11, (shown by a dot-dashed line in FIG. 2) inserted into the paper inlet 2*b*, to be forced back by the belt 10 of the conveyor 4 upstream of the passageway A. As a result, the insertion of the narrow sheet of copying paper 11 into the right-hand portion of the inlet 2*b* is prevented. Similarly, although a narrow sheet of copying paper 11 is inserted from the left-hand portion of the paper inlet 2*b*, the feed sensor 21 is not actuated. As a result, the sheet of copying paper 11 is forced back upstream of the passageway A by the conveyor belt 10 to thereby prevent the insertion of that paper. On the other hand, when the narrow sheet of copying paper 11 is inserted from the central portion of the paper inlet 2*b*, the feed sensor 21 is actuated. As a result, the control system 40, as shown in FIG. 3, drives the motor M1 forwardly and also the motor M2, so that the sheet of copying paper 11 is conveyed downstream of the passageway A while being drawn to the belt 10 of the conveyor 4 to pass over the jam sensor 13. As shown in FIG. 2, a wide sheet of copying paper 12 will actuate the feed sensor 21 although it is inserted from the right-hand or left-hand portion of the paper inlet 2*b*, so that in this case, the control system 40 shown in FIG. 3 drives the motor M1 forwardly and also the motor M2. Therefore, the wide sheet of copying paper 11 is conveyed downstream of the conveyor passageway A while being drawn to the conveyor belt 10 to thereby pass over the jam sensor 13. When each of the sheets of copying paper 11 and 12 has passed over the feed sensor 21 and the jam sensor 13, these sensors 13 and 21 are released from their actuation, in which case the controller 41 of the control system 40, shown in FIG. 3, determines that there is no sheet of copying paper on the conveyance passageway A to thereby cause a timer, not shown, to return the motor M1 to its reversing operation after a predetermined time has passed (two seconds in this embodiment) and to stop the motor M2 at the same time In the above embodiment, since the motor M1 and the roller 7 of the paper discharger 5 are coupled by the one-way clutch 29, the reverse operation of the motor M1 will stop the rotation of the roller 7. Therefore, the sheet of copying paper 15 discharged backwardly from the paper discharger 5 will not be again drawn back by the discharger 5 into the apparatus body 2.

Figure 4:
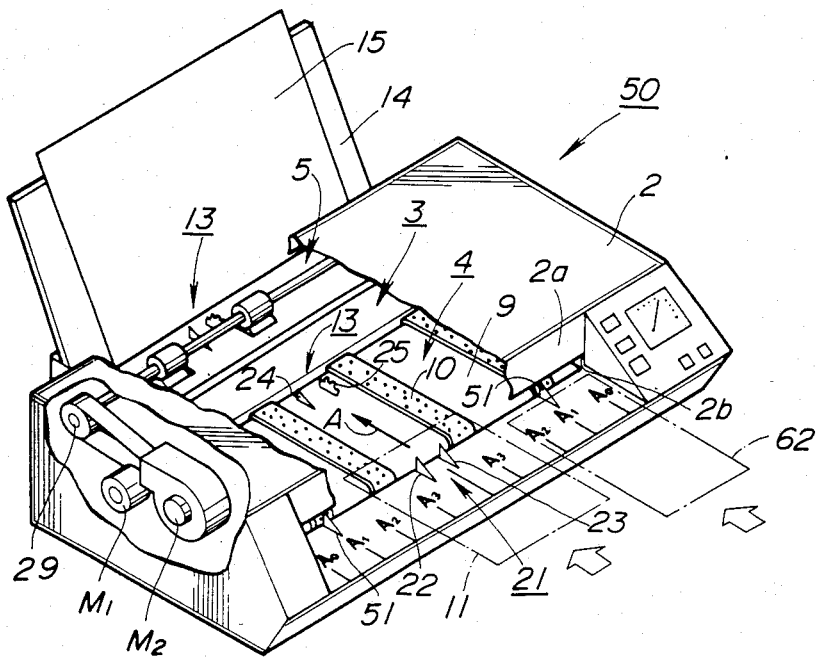
FIG. 4 is a perspective view of another embodiment of an off-line image fixing apparatus according to this invention with its parts being broken away to show the essential portion of the apparatus.

In the above embodiment, the feed sensor 21 disposed only in the center of the paper inlet 2*b*, and the control system 40 which rotates the conveyor 4 forwardly in accordance with a paper sensing signal from the feed sensor 21 are provided so as to cause a sheet of copying paper to pass at all times over the jam sensors 13 to thereby sense paper jamming irrespective of the size of the sheet of copying paper. However, this invention is not limited to this embodiment. Alternatively, as shown in FIG. 4 in which the same reference numeral as that in FIG. 2 denotes the same element as that in FIG. 2, an image fixing apparatus 50 may be provided in which a feed sensor 51 including a photointerrupter type sensor is additionally provided near each end of the paper inlet 2*b*, a paper sensing signal from which sensor is used to reverse the conveyor 4 and also to drive the motor M2 which will produce a vacuum in the conveyor 4.

Figure 5:
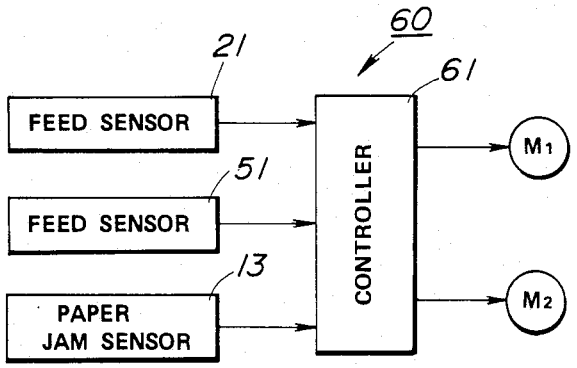
FIG. 5 is a block diagram of a control system used in the image fixing apparatus shown in FIG. 4.

FIG. 5 is a block diagram of a control system 60 which controls the motors M1 and M2 in accordance with the respective paper sensing signals from the jam sensor 13 and feed sensors 21 and 51 used in the image fixing apparatus 50. A controller 61 of the control system 60 continuously provides a reverse dive signal to the motor M1 and delivers a forward drive signal to the motor M1 in accordance with one or both of the paper sensing signals from the jam sensor 13 and feed sensor 21 to convey by the conveyor 4 a sheet of copying paper inserted from the paper inlet 2*b* to the heating unit 3. It is to be noted that when the motor M1 is driven forwardly, the motor M2 is also driven simultaneously to cause a sheet of copying paper to be drawn to the paper conveyor 4.

When the controller 61 receives paper detection signals from the respective feed sensors 51, one disposed near each end of the paper inlet 2*b*, irrespective of whether or not one or both of the jam sensor 13 and feed sensor 21 is actuated, it delivers a reverse drive signal to the motor M1 and, at the same time, a drive signal to the motor M2 to thereby produce a vacuum in the paper conveyor 4.

The operation of the image fixing apparatus, as just described, will now be described.

As shown in FIG. 4, when a narrow sheet of copying paper 11 is entered centrally at the paper inlet 2*b*, the feed sensor 21 is actuated, so that the motor M1 is driven forwardly and the motor M2 is also driven. Therefore, the sheet of copying paper 11 is drawn to the belt 10 of the conveyor 4 and conveyed to the heating unit 3. If a narrow sheet of copying paper 62 is additionally inserted from one end of the paper inlet 2*b*, it will actuate the corresponding feed sensor 51 to thereby produce a paper sensing signal which causes the controller 61 to deliver a reverse drive signal to the motor M1 while the motor M2 maintains its rotation. As just described, when two sheets of copying paper 11 and 62 are inserted from the paper inlet 2*b* and one sheet 62 actuates the corresponding feed sensor 51, the conveyor 4 is reversed, and the generation of a vacuum is maintained, so that it is ensured that these two sheets of copying paper 11 and 62 are drawn to the conveyor 4 by the action of the vacuum produced by the conveyor 4 and discharged back from the paper inlet 2*b* of the body 2. As just described, the provision of the additional feed sensor 51 near each end of the paper inlet so as to reverse the the conveyor 4 by a paper sensing signal from any one of the feed sensors 51 serve to discharge back from the paper inlet 2*b* two sheets of copying paper 11 and 62 inserted at the same time from one end and the center, respectively, of the paper inlet 2*b*. Thus this arrangement serves to avoid the occurrence of an accident in which a sheet of copying paper 62 inserted from one end portion of the paper inlet 2*b* would not pass over the jam sensor 13 with the result that when the sheet of copying paper 62 happens to jam within the apparatus body 2, the jamming cannot be detected and the sheet of copying paper 62 would be scorched. If a sheet of copying paper is inserted from only the central portion of the inlet 2*b*, the feed sensor 21 will be actuated to produce a paper sensing signal which causes the controller 61, shown in FIG. 5, to deliver a forward drive signal to the motor M1 and a drive signal to the motor M2. Therefore, the sheet of copying paper inserted from the central portion of the paper inlet 2*b* will be drawn to the conveyor 4 to pass over the jam sensor 13 to the heating unit 3. Thus, paper jamming is detected necessarily.

When a sheet of copying paper has passed over the feed sensor 21 and the jam sensor 13 which are then released from their actuation, the controller 61 shown in FIG. 5 determines, like the controller 40 shown in FIG. 3, that there is no sheet of copying paper on the conveyance passageway A to thereby cause a timer, not shown, within the controller 61 to deliver a reverse drive signal to the motor M1 and a drive stopping signal to the motor M2 after a lapse of a predetermined time ( two seconds in this embodiment) to return the apparatus to its normal or standby state in which the apparatus waits for the insertion of another sheet of copying paper.

This invention could be carried out in other various forms without departing from the spirit and main features thereof. Therefore, the above embodiments are provided only in an illustrative sense in all respects and should not be interpreted in a limitative sense. The scope of this invention is represented by the attached claims and not restricted by the text of the specification. In addition, various changes and modifications falling within the equivalent scope of the claims are all intended to be included in the scope of this invention.

What is claimed is:

1. An off-line image fixing apparatus comprising:
   - paper inlet means formed at the front of the apparatus body;
   - paper conveyance passageway means extending from the paper inlet means toward heating means disposed at a rearward portion backward within the apparatus body;
   - paper conveyor means disposed in the passageway means immediately after the paper inlet means;
   - paper jam sensor means disposed at substantially the center of the width of the passageway means for sensing paper jamming which may occur in the passageway means;
   - feed sensor means disposed at a position in the paper inlet means corresponding to substantially the center of the width of the passageway means for sensing the presence of a sheet of copying paper; and
   - control means for in a normal state continuously driving the paper conveyor means backwardly to discharge back from the paper inlet means of the apparatus body a sheet of copying paper inserted from the inlet means, and for driving the conveyor means in accordance with a paper sensing signal from the feed sender means or both the feed sensor means and the jam sensor means to thereby convey a sheet of unfixed copying paper inserted from the inlet means through the passageway means to the heating means.

2. An off-line image fixing apparatus according to claim 1, wherein the conveyor means includes a vacuum type paper conveyor device which in turn includes a conveyor belt, a first motor for driving the conveyor belt forwardly or backwardly, and a second motor for generating a vacuum.

3. An off-line image fixing apparatus according to claim 1, wherein the jam sensor means includes a photointerrupter type sensor for sensing the presence of a sheet of copying paper and a photopulse generation type sensor for sensing the moving condition of the sheet of copying paper.

4. An off-line image fixing apparatus according to claim 1, wherein the feed sensor means includes a pair of photointerrupter type sensors disposed so as to have the jam sensor means therebetween, as the downstream portion of the passageway means is viewed from the paper inlet means.

5. An off-line image fixing apparatus according to claims 1 or 2, wherein the control means in a controller for in the normal state continuously delivering to the first motor a drive signal to backwardly drive the conveyor belt of the conveyor means, and for delivering a drive signal to the first motor to forwardly drive the conveyor belt of the conveyor means and a drive signal to the second motor to generate a vacuum at the conveyor means in accordance with a paper sensing signal from the feed sensor means or both the feed sensor and jam sensor means.

6. An off-line image fixing apparatus comprising:

paper inlet means formed at the front of the apparatus body;

paper conveyance passageway means extending from the paper inlet means toward heating means disposed backward within the apparatus body;

paper conveyor means disposed in the passageway means immediately after the paper inlet means;

paper jam sensor means disposed at substantailly the center of the width of the passageway means for sensing paper jamming which may occur in the passageway means;

first feed sensor means disposed at a position in the paper inlet means corresponding to substantially the center of the width of the passageway means for sensing the presence of a sheet of copying paper; and second feed sensor means disposed near each end of the paper inlet for sensing the presence of a sheet of copying paper;

control means for in a normal state continuously driving the paper conveyor means backwardly to discharge back from the paper inlet means of the apparatus body a sheet of copying paper inserted from the inlet means, for driving the conveyor means forwardly in accordance with a paper sensing signal from the first feed sensor means or both the first feed sensor means and the jam sensor means to thereby convey the sheet of copying paper inserted from the inlet means through the passageway means to the heating means, and for driving the conveyor means backwardly in accordance with a paper detection signal from the second feed sensor to discharge back from the inlet means of the apparatus body the sheet of copying paper inserted from the paper inlet means.

7. An off-line image fixing apparatus according to claim 6, wherein the conveyor means includes a vacuum type paper conveyor device which in turn includes a conveyor belt, a first motor for driving the conveyor belt forwardly or backwardly, and a second motor for generating a vacuum.

8. An off-line image fixing apparatus according to claim 6, wherein the jam sensor means includes a photointerrupter type sensor for sensing the presence of a sheet of copying paper and a photopulse generation type sensor for sensing the moving condition of the sheet of copying paper.

9. An off-line image fixing apparatus according to claim 6, wherein the first feed sensor means includes a pair of photointerrupter type sensors disposed so as to have the jam sensor means therebetween, as the downstream portion of the passageway means is viewed from the paper inlet means.

10. An off-line image fixing apparatus according to claim 6, wherein the second feed sensor means includes a photointerrupter type sensor.

11. An off-line image fixing apparatus according to claim 7, wherein the control means includes a controller for in the normal state continuously delivering to the first motor a drive signal to backwardly drive the conveyor belt of the conveyor means, for delivering a drive signal to the first motor to forwardly drive the conveyor belt of the conveyor means and a drive signal to the motor M2 to generate a vacuum at the conveyor means in accordance with a paper sensing signal from the first feed sensor means or both the first feed sensor means and jam sensor means, and for delivering a drive signal to the first motor to backwardly drive the conveyor belt of the conveyor means in accordance with only a paper sensing signal from the second feed sensor means.

* * * * *